US012677862B2

(12) United States Patent
Deforel et al.

(10) Patent No.: US 12,677,862 B2
(45) Date of Patent: Jul. 14, 2026

(54) CLOVE-CONTAINING AEROSOL-GENERATING SUBSTRATE

(71) Applicant: Philip Morris Products S.A., Neuchatel (CH)

(72) Inventors: Corinne Deforel, Neuchatel (CH); Gerhard Lang, Neuchatel (CH); Celine Lesuffleur, Neuchatel (CH); Aline Vuarnoz-Bize, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 879 days.

(21) Appl. No.: 17/282,210

(22) PCT Filed: Oct. 8, 2019

(86) PCT No.: PCT/EP2019/077254

§ 371 (c)(1),
(2) Date: Apr. 1, 2021

(87) PCT Pub. No.: WO2020/074535

PCT Pub. Date: Apr. 16, 2020

(65) Prior Publication Data

US 2021/0329964 A1 Oct. 28, 2021

(30) Foreign Application Priority Data

Oct. 8, 2018 (EP) ..... 18199205

(51) Int. Cl.
*A24B 3/14* (2006.01)
*A24B 15/14* (2006.01)
(Continued)

(52) U.S. Cl.
CPC ..... *A24B 3/14* (2013.01); *A24B 15/14* (2013.01); *A24B 15/167* (2016.11);
(Continued)

(58) Field of Classification Search
None
See application file for complete search history.

(56) References Cited

U.S. PATENT DOCUMENTS 3,860,012 A 1/1975 Selke
3,894,544 A 7/1975 Egri
(Continued)

FOREIGN PATENT DOCUMENTS

CN 1970708 A 5/2007
CN 107429490 A 12/2017
(Continued)

OTHER PUBLICATIONS

Indian Examination Report issued on Sep. 29, 2022 in Indian Patent Application No. 202117008016, 6 pages.
(Continued)

*Primary Examiner* — Manley L Cummins, IV
(74) *Attorney, Agent, or Firm* — Oblon, McClelland, Maier & Neustadt, L.L.P.

(57) ABSTRACT

An aerosol-generating article is provided, including an aerosol-generating substrate including homogenised plant material formed of particulate plant material, the particulate plant material including between 10 percent and 40 percent by weight clove particles and between 60 percent and 90 percent by weight tobacco particles, based on dry weight of the particulate plant material, and the homogenised plant material further including an aerosol former and a binder. An aerosol-generating system is also provided, including an aerosol-generating device including a heating element; and the aerosol-generating article. A method is also provided for making one or more sheets of the homogenised plant material of aerosol-generating substrate of the aerosol-generating article.

7 Claims, 7 Drawing Sheets

(51) Int. Cl.

| | |
|---|---|
| ***A24B 15/167*** | (2020.01) |
| ***A24B 15/28*** | (2006.01) |
| ***A24B 15/30*** | (2006.01) |
| ***A24B 15/34*** | (2006.01) |
| ***A24C 5/01*** | (2020.01) |
| ***A24D 1/20*** | (2020.01) |
| ***A24D 1/22*** | (2020.01) |
| ***A24F 40/20*** | (2020.01) |

(52) U.S. Cl.

CPC ..... *A24B 15/285* (2013.01); *A24B 15/301* (2013.01); *A24B 15/302* (2013.01); *A24B 15/345* (2013.01); *A24C 5/01* (2020.01); *A24D 1/20* (2020.01); *A24D 1/22* (2020.01); *A24F 40/20* (2020.01)

(56) References Cited

U.S. PATENT DOCUMENTS

| | | | | |
|---|---|---|---|---|
| 4,144,894 | A * | 3/1979 | Schmidt | A24B 15/14 131/355 |
| 4,319,593 | A * | 3/1982 | Pinion | A24B 15/12 131/372 |
| 5,119,836 | A | 6/1992 | White | |
| 5,724,998 | A | 3/1998 | Gellatly et al. | |
| 6,935,347 | B2 | 8/2005 | Patel | |
| 2003/0131858 | A1 | 7/2003 | Patel | |
| 2008/0206432 | A1 | 8/2008 | Torrens et al. | |
| 2011/0309559 | A1 | 12/2011 | Franke et al. | |
| 2012/0006343 | A1* | 1/2012 | Renaud | A24B 15/165 131/194 |
| 2015/0150302 | A1 | 6/2015 | Metrangolo et al. | |
| 2019/0269169 | A1* | 9/2019 | Malgat | A24D 1/02 |

FOREIGN PATENT DOCUMENTS

| | | | |
|---|---|---|---|
| CN | 108420124 | A | 8/2018 |
| EA | 013849 | B1 | 8/2010 |
| EP | 0 822 760 | A | 2/1998 |
| EP | 1252830 | A1 | 10/2003 |
| EP | 3 075 266 | A1 | 10/2016 |
| GB | 983928 | A | 2/1965 |
| JP | 2016-195585 | A | 11/2016 |
| KR | 10-2017-0131381 | A | 11/2017 |
| RU | 50 770 | U1 | 1/2006 |
| WO | WO 90/00019 | A2 | 1/1990 |
| WO | WO 96/32854 | A2 | 10/1996 |
| WO | WO 2007/007269 | A2 | 1/2007 |
| WO | WO 2007/010407 | A2 | 1/2007 |
| WO | WO 2009/022232 | A2 | 2/2009 |
| WO | WO 2009/127894 | A1 | 10/2009 |
| WO | WO 2010/069686 | A2 | 6/2010 |
| WO | WO 2011/060961 | A1 | 5/2011 |
| WO | WO 2013/034488 | A2 | 3/2013 |
| WO | WO 2013/068100 | A1 | 5/2013 |
| WO | WO 2013/068304 | A1 | 5/2013 |
| WO | WO 2013/178766 | A1 | 12/2013 |
| WO | WO 2013/178767 | A1 | 12/2013 |
| WO | WO 2013/178768 | A1 | 12/2013 |
| WO | WO 2014/154887 | A1 | 10/2014 |
| WO | WO 2015/082652 | A1 | 5/2015 |
| WO | WO 2015/097187 | A1 | 7/2015 |
| WO | WO 2015/193031 | A1 | 12/2015 |
| WO | WO 2015/197554 | A1 | 12/2015 |
| WO | WO 2016/156219 | A1 | 10/2016 |
| WO | WO 2016/174013 | A1 | 11/2016 |
| WO | WO 2017/041920 | A1 | 3/2017 |
| WO | WO 2018/215481 | A1 | 11/2018 |
| WO | WO 2020/074494 | A1 | 4/2020 |
| WO | WO 2012/164009 | A2 | 12/2021 |

OTHER PUBLICATIONS

Piadé, J.-J., et al., "Toxicological assessment of kretek cigarettes Part 2: Kretek and American-blended cigarettes, smoke chemistry and in vitro toxicity", Regulatory Toxicology and Pharmacology—vol. 70, (2014), pp. S15-S25.

Combined Russian Office Action and Search Report issued Feb. 3, 2023, in corresponding Russian Patent Application No. 2021111296 (with English Translation), 11 pages.

International Search Report and Written Opinion issued Dec. 13, 2019 in PCT/EP2019/077254 filed Oct. 8, 2019.

Combined Chinese Office Action and Search Report issued Mar. 29, 2022 in Patent Application No. 201980061898.4 (with English language translation), 19 pages.

Korean Office Action issued Jan. 2, 2025 in Korean Patent Application No. 10-2021-7013517 (with English Translation), 9 pages.

Office Action mailed on Jan. 22, 2028, in corresponding Brazilian Patent Application No. 1120210050728.

Clove (syzgium aromaticum): a precious spice; Asian Pacific Journal of Tropical Biomedicine 2014; 4(2); 90-96.

Chemincal composition and antioxidant properties of clove leaf essential oil; Journal of Agriculture and Food Chemistry 2006. 54, 6303-6307.

* cited by examiner

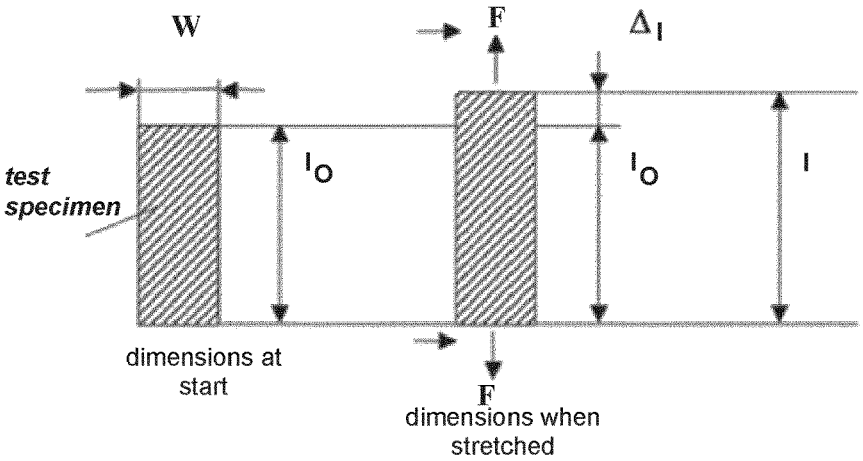

| | | | |
|---|---|---|---|
| w | = | Width of the test specimen | [mm] |
| l o | = | Initial length between grips | [mm] |
| l | = | Length between grips during the stretch | [mm] |
| $\Delta l$ | = | Elongation during the stretch (*l = l – lo) | [mm] |
| F | = | Force during the stretch | [N] |

Figure 8

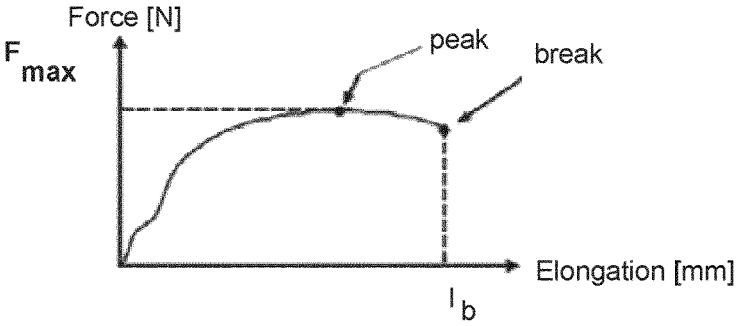

| | | | |
|---|---|---|---|
| L | = | Load max | [N] |
| S | = | Tensile strength | [N/mm] |
| S at break | = | Tensile Breaking Strength | [N/15 mm] |
| $\varepsilon_b$ | = | Stretch at break [%] | |
| $F_{max}$ | = | Maximum force during the stretch | [N] |
| w | = | Width of the test specimen | [mm] |
| l | = | Initial length between grips | [mm] |
| $\Delta l$ | = | Elongation at break | [mm] |

| | |
|---|---|
| Tensile peak strength | $S = \frac{F_{max}}{w}$ [N/mm] |
| Stretch at break | $\varepsilon_b = \frac{\Delta l_b}{l_o} \cdot 100$[%] |
| Force at break | L = Load max [N] |
| Tensile breaking strength | S at break = F at break [N/15 mm] |

The maximum force at break is used to quantify the tensile breaking strength. As the width of the sample is 15.0 mm, the unit becomes N/15mm.

Figure 9

CLOVE-CONTAINING AEROSOL-GENERATING SUBSTRATE

The present invention relates to aerosol-generating substrates comprising homogenised plant material formed from clove particles. The homogenised plant material may also comprise tobacco particles.

Aerosol-generating articles in which an aerosol-generating substrate, such as a tobacco-containing substrate, is heated rather than combusted, are known in the art. Typically in such articles, an aerosol is generated by the transfer of heat from a heat source to a physically separate aerosol-generating substrate or material, which may be located in contact with, within, around, or downstream of the heat source. During use of the aerosol-generating article, volatile compounds are released from the substrate by heat transfer from the heat source and are entrained in air drawn through the article. As the released compounds cool, they condense to form an aerosol.

Some aerosol-generating articles comprise a flavourant that is delivered to the consumer during use of the article to provide a different sensory experience to the consumer, for example to enhance the flavour of aerosol. A flavourant can be used to deliver a gustatory sensation (taste), an olfactory sensation (smell), or both a gustatory and an olfactory sensation to the user inhaling the aerosol. It is known to provide heated aerosol-generating articles that include flavourants.

It is also known to provide flavourants in conventional combustible cigarettes, which are smoked by lighting the end of the cigarette opposite the mouthpiece so that the tobacco rod burns, generating inhalable smoke. One or more flavourants are typically mixed with the tobacco in the tobacco rod in order to provide additional flavour to the mainstream smoke as the tobacco is burnt. Such flavourants can be provided for example naturally as botanical material, such as in the form of natural clove material (for example, natural cut cloves). An example of such a smoking article is known as a "kretek" cigarette, in which clove material, such as clove particles, is included with the tobacco in the tobacco rod. The proportion of cloves to tobacco varies in kretek cigarettes but may be as high as 50:50. As the cloves in kretek cigarettes are burnt, their flavour and aroma are released into the mainstream smoke. Such smoking articles are popular in certain countries, such as Indonesia.

There are difficulties involved in replicating the flavours in conventional combustible cigarettes with aerosol-generating articles in which the aerosol-generating substrate is heated rather than combusted. This is partially due to the lower temperatures reached during the heating of such aerosol-generating articles, leading to a different profile of volatile compounds being released. It would be desirable to provide a novel aerosol-generating substrate for a heated aerosol-generating article providing an improved flavour delivery to the consumer. In particular, it would be desirable to provide an aerosol-generating substrate that provides an improved clove flavour to the consumer, comparable to the flavour provided in a combustible kretek cigarette. It would be further desirable to provide such an aerosol-generating substrate that can be readily incorporated into an aerosol-generating article and which can be manufactured using existing high-speed methods and apparatus.

EP3075266 A1 discloses aerosol-generating articles made from reconstituted tobacco material and added flavour. The flavour may be clove and/or clove oil and/or other clove product, although no amounts of these flavourants or technical advantages are disclosed.

The present inventors have provided aerosol-generating substrates comprising homogenised plant material formed from clove particles, in order to provide clove aromas upon heating of the substrate. The substrates are suitable for use with an aerosol-generating device comprising a heating element. Upon heating, the substrates produce an aerosol from the homogenised plant material, the aerosol comprising one or more flavourants from clove particles or clove particles and tobacco particles in a mixture.

According to a first aspect of the invention there is provided an aerosol-generating substrate comprising homogenised plant material comprising particulate plant material, the particulate plant material comprising between 10 percent and 100 percent by weight clove particles and between 0 percent and 90 percent by weight tobacco particles, based on dry weight of the particulate plant material. The particulate plant material consists of clove material, or a mixture of clove material and tobacco material; that is, clove material, or a mixture of clove material and tobacco material accounts for 100 percent of the particulate plant material. The particulate plant material may comprise no tobacco particles and 100 percent clove particles, based on the dry weight of the particulate plant material. The particulate plant material may preferably comprise between 10 percent and 60 percent by weight clove particles and between 40 percent and about 90 percent by weight tobacco particles, more preferably between 30 percent and 40 percent by weight clove particles and between 70 percent and 60 percent by weight tobacco particles, based on the dry weight of the particulate plant material. The aerosol-generating substrate may comprise a total content of between 40 percent and 90 percent by weight tobacco particles and a total content of between 10 percent and 60 percent by weight clove particles, based on dry weight of the substrate.

The aerosol-generating substrate may be suitable for use in an aerosol-generating article for use with an aerosol-generating device comprising a heating element.

The tobacco particles may have a nicotine content of at least 2.5 percent by weight, based on dry weight. More preferably, the tobacco particles may have a nicotine content of at least 3 percent, even more preferably at least 3.2 percent, even more preferably at least 3.5 percent, most preferably at least 4 percent by weight, based on dry weight. When the aerosol-generating substrate contains tobacco particles in combination with clove particles, tobaccos having a higher nicotine content are preferred to maintain similar levels of nicotine relative to typical aerosol-generating substrates without clove particles, since the total amount of nicotine would otherwise be reduced due to substitution of tobacco particles with clove particles.

The homogenised plant material used in substrates according to the invention may be produced by various processes including paper making, casting, dough reconstitution, extrusion or any other suitable process.

Some processes such as casting and paper making are more suitable for producing homogenised plant material in sheet form. The term "cast leaf" is used herein to refer to a product made by a casting process that is based on casting a slurry comprising plant particles (for example, clove particles or tobacco particles and clove particles in a mixture) and a binder (for example, guar gum) onto a supportive surface, such as a belt conveyor, drying the slurry and removing the dried sheet from the supportive surface. An example of the casting or cast leaf process is described in, for example, U.S. Pat. No. 5,724,998 for making cast leaf tobacco. In a cast leaf process, particulate plant materials are produced by pulverizing, grinding, or comminuting parts of the plant. The particles produced from one or more plants are mixed with a liquid component, typically water, to form a slurry. Other components in the slurry may include fibres, a binder and an aerosol former. The particulate plant materials may be agglomerated in the presence of the binder. The slurry is cast onto a supportive surface and dried into a sheet of homogenised plant material. Preferably, the homogenised plant material used in articles according to the present invention may be produced by casting. Such homogenised plant material may comprise agglomerated particulate plant material.

The paper-making process for producing sheets of homogenised plant material comprises a first step of mixing a plant material and water to form a dilute suspension comprising mostly of separate cellulose fibers. This first step may involve soaking and applying heat. The suspension has a lower viscosity and a higher water content than the slurry produced in the casting process. The suspension may then be separated into an insoluble portion containing solid fibrous components and a liquid or aqueous portion comprising soluble plant substances. The water remaining in the insoluble fibrous portion may be drained through a screen, acting as a sieve, such that a web of randomly interwoven fibers may be laid down. Water may be further removed from this web by pressing with rollers, sometimes aided by suction or vacuum. When most of the moisture has been removed, a generally flat, uniform sheet of plant fibers is achieved. The soluble plant substances that were removed from the sheet may be concentrated, and the concentrated plant substances may be added back to the sheet resulting in a sheet of homogenised plant material. This process, as described in U.S. Pat. No. 3,860,012, has been used with tobacco to make reconstituted tobacco products, also known as tobacco paper.

Other known processes that can be applied to producing homogenised plant materials are dough reconstitution processes of the type described in, for example, U.S. Pat. No. 3,894,544; and extrusion processes of the type described in, for example, in GB-A-983,928. Typically, the densities of homogenised plant materials produced by extrusion processes and dough reconstitution processes are greater than the densities of the homogenised plant materials produced by casting processes.

The tensile strength is a measure of force required to stretch a sheet of material until it breaks. Paper-making processes typically yield sheets with relatively higher tensile strengths than those produced by cast-leaf, dough reconstitution or extrusion. It would be desirable to provide a method of making a sheet of homogenised plant material with greater tensile strength whereby particulate plant material is agglomerated by a binder, by contrast to paper-making processes in which soluble plant materials are extracted and reintroduced. In a cast-leaf process, because substantially all the soluble fraction is kept within the plant material, most flavours are advantageously preserved. Additionally, energy-intensive paper-making steps are avoided.

Cloves and tobacco have a distinctive, usually fragrant smell. Typically, the flavour released by such plants is due to the presence of one or more flavourants which are volatile compounds in the plant material, and which are volatilised upon heating. By way of example, the main ingredient of clove essential oil is eugenol (4-allyl-2-methoxyphenol, chemical formula: $C_{10}H_{12}O_2$, Chemical Abstracts Service Registry Number 97-53-0). Eugenol is the compound primarily responsible for clove flavour and typically makes up between about 70% and about 90% of clove essential oil. However, the clove flavour also includes other compounds, for example, but not limited to acetyl eugenol, beta-caryophyllene and vanillin, crategolic acid, tannins such as bicornin, gallotannic acid, methyl salicylate, the flavonoids eugenin, kaempferol, rhamnetin and eugenitin, triterpenoids such as oleanolic acid, and sesquiterpenes. The presence of clove flavour is preferably determined by measuring the eugenol content of the homogenised plant material (or alternatively the eugenol content of aerosol produced when the homogenised plant material is heated). However, the presence of clove flavour may also be determined by measuring the content of other compounds found in clove essential oil including, but not limited to, those listed above.

As used herein with reference to the invention, the term "tobacco material" encompasses ground or powdered tobacco leaf lamina, ground or powdered tobacco leaf stems, tobacco dust, tobacco fines, and other particulate tobacco by-products formed during the treating, handling and shipping of tobacco. By contrast, isolated nicotine and nicotine salts are compounds derived from tobacco but are not considered tobacco material for purposes of the invention and are not included in the percentage of particulate plant material.

Particle sizes herein are stated as D-values, whereby the D-value refers to the percentage of particles by number with a diameter of less than or equal to the given D-value. For instance, in a D90 particle size distribution, 90 percent of the particles by number are of a diameter less than or equal to the given D90 value, and 10% percent of the particles by number are of a diameter measuring greater than the given D90 value.

The particulate plant material may have a D90 value of from greater than or equal to 20 microns to a D90 value of less than or equal to 300 microns. By this is meant that the particulate plant material may be of a distribution represented by any D90 value within the given range, that is D90 may be equal to 20 microns, or D90 may be equal to 25 microns, et cetera, all the way up to D90 may be equal to 300 microns. Preferably the particulate plant material may have a D90 value of from greater than or equal to 30 microns to a D90 value of less than or equal to 120 microns, more preferably a D90 value of from greater than or equal to 40 microns to a D90 value of less than or equal to 80 microns. The particulate clove material and the particulate tobacco material may both have D90 values of from greater than or equal to 20 microns to D90 values of less than or equal to 300 microns, preferably D90 values of from greater than or equal to 30 microns to D90 values of less than or equal to 120 microns, more preferably D90 values of from greater than or equal to 40 microns to D90 values of less than or equal to 80 microns. The diameter of 100 percent of the particulate plant material may be less than or equal to 350 microns, more preferably less than or equal to 400 microns. The diameter of 100 percent of the particulate clove material and 100 percent of the particulate tobacco material may be less than or equal to 400 microns, more preferably less than or equal to 350 microns. The particle size range of the clove particles enables clove particles to be combined with tobacco particles in existing cast leaf processes.

In some embodiments, tobacco may be purposely ground to form particulate tobacco material having a defined particle size distribution, for use in the homogenised plant material. This provides the advantage that the size of the tobacco particles can be controlled to provide a desired particle size distribution. The use of purposely ground tobacco therefore advantageously improves the homogeneity of the particulate tobacco material and the consistency of the homogenised tobacco material. This enables aerosol-generating article having a consistent delivery of aerosol to be provided.

Furthermore, specific portions of the tobacco plant may be selected and ground to the desired size. For example, tobacco lamina may be ground to form the particulate tobacco material. This also contributes to an improvement in the consistency of the homogenised plant material, for example, compared to a material formed using waste tobacco.

The tobacco particles may be prepared from one or more varieties of tobacco plants. Any type of tobacco may be used in a blend. Examples of tobacco types that may be used include, but are not limited to, sun-cured tobacco, flue-cured tobacco, Burley tobacco, Maryland tobacco, Oriental tobacco, Virginia tobacco, other speciality tobaccos, blends thereof and the like. Kasturi is a type of sun-cured tobacco that is commonly used in Kretek cigarettes. Other examples of sun-cured tobacco are Madura and Jatim. Burley is a type of tobacco which plays a significant role in many tobacco blends. Burley has a distinctive flavour and aroma and also has an ability to absorb large amounts of casing.

Flue-curing is a method of curing tobacco, which is particularly used with Virginia tobaccos. During the flue-curing process, heated air is circulated through densely packed tobacco. During a first stage, the tobacco leaves turn yellow and wilt. During a second stage, the laminae of the leaves are completely dried. During a third stage, the leaf stems are completely dried.

Oriental is a type of tobacco which has small leaves, and high aromatic qualities. However, Oriental tobacco has a milder flavour than, for example, Burley. Generally, therefore, Oriental tobacco is used in relatively small proportions in tobacco blends.

Preferably, Kasturi tobacco and flue-cured tobacco may be used in a blend to produce the tobacco particles. Accordingly, the tobacco particles in the particulate plant material may comprise a blend of Kasturi tobacco and flue-cured tobacco.

Although it is considered a non-tobacco material for purposes of the invention, nicotine may optionally be incorporated into the substrate. The nicotine may comprise one or more nicotine salts selected from the list consisting of nicotine citrate, nicotine pyruvate, nicotine bitartrate, nicotine pectates, nicotine alginates, and nicotine salicylate. Nicotine may be incorporated in addition to a tobacco with low nicotine content, or as an alternative to tobacco in substrates intended to have a reduced or zero tobacco content.

As is known, cloves are effectively dried flower buds and stems of *Syzygium aromaticum*, a tree in the family Myrtaceae, and are commonly used as a spice. Accordingly, each clove comprises a calyx of sepals and a corolla of unopened petals, which form a ball-like portion attached to the calyx. As used herein, the term "clove material" encompasses particles derived from *Syzygium aromaticum* buds and stems and may include whole cloves, ground or crushed cloves, or cloves that have been otherwise physically processed to reduce the particle size. By contrast, clove essential oil and eugenol are compounds derived from cloves but are not considered clove material for purposes of the invention and are not included in the percentages of particulate plant material.

The inclusion of clove particles in homogenised plant material in the aerosol-generating substrate provided herein, either as the sole plant material or in combination with tobacco material, has presently been found to provide an improved clove aroma during use of the aerosol-generating substrate in an aerosol-generating article compared to addition of clove additives such as clove oil. The inventors have found that substrates that do not contain clove particles and instead contain clove oil do not deliver a balanced clove aroma. Moreover, in certain aerosol-generating substrates provided herein, clove particles may be incorporated at a sufficient level to provide the desired clove aromas whilst maintaining sufficient tobacco material to provide the desired level of nicotine to the consumer. In one embodiment, the aerosol-generating substrate comprises one or more sheets of homogenised plant material formed of particulate plant material. In one embodiment, the sheets of homogenised plant material may contain tobacco particles and clove particles within the same sheet. In other embodiments, the sheets of homogenised plant material may contain tobacco particles and clove particles within different sheets.

The homogenised plant material is preferably in the form of a solid or a gel. However, in some embodiments the homogenised material may be in the form of a solid that is not a gel. Preferably, the homogenised material is not in the form of a film.

The homogenised plant material of the aerosol-generating substrate according to the invention can advantageously comprise all of the particulate plant material that it is required for incorporation into the aerosol-generating substrate. The composition of the homogenised plant material can advantageously be adjusted through the blending of desired amounts and types of the different plant particles. This enables an aerosol-generating substrate to be formed from a single homogenised plant material, if desired, without the need for the combination or mixing of different blends, as is the case for example in the production of conventional cut filler. The production of the aerosol-generating substrate can therefore potentially be simplified.

As used herein, the term "aerosol-generating substrate" refers to a substrate capable of releasing upon heating volatile compounds, which can form an aerosol. The aerosol generated from aerosol-generating substrates of aerosol-generating articles described herein may be visible or invisible and may include vapors (for example, fine particles of substances, which are in a gaseous state, that are ordinarily liquid or solid at room temperature) as well as gases and liquid droplets of condensed vapors. As used herein, the term "aerosol-generating article" refers to an article for producing an aerosol comprising an aerosol-generating substrate that is suitable and intended to be heated or combusted in order to release volatile compounds that can form an aerosol. A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol-generating articles, an aerosol is generated by heating an aerosol-generating substrate, such as tobacco. Known heated aerosol-generating articles include, for example, electrically heated aerosol-generating articles and aerosol-generating articles in which an aerosol is generated by the transfer of heat from a combustible fuel element or heat source to a physically separate aerosol-generating substrate.

As used herein, the term "plug" denotes a generally cylindrical element having a substantially circular, oval or elliptical cross-section.

As used herein, the term "rod" refers to a generally cylindrical element of substantially polygonal cross-section and preferably of circular, oval or elliptical cross-section. A rod may have a length greater than or equal to the length of a plug. Typically, a rod has a length that is greater than the length of a plug. A rod may comprise one or more plugs.

As used herein, the term "sheet" denotes a laminar element having a width and length substantially greater than the thickness thereof. The width of a sheet is greater than 10 mm, preferably greater than 20 mm, 30 mm, 50 mm, 100 mm, 120 mm, 130 mm, or 150 mm.

The homogenised plant material may comprise one or more binders to help agglomerate the particulate plant material. Alternatively, or in addition, the homogenised plant material may comprise other additives including, but not limited to, lipids, fibers, aerosol formers, humectants, plasticisers, flavourants, fillers, aqueous and non-aqueous solvents and combinations thereof.

A binder may be endogenous or exogenous to the particulate plant material. Suitable binders for inclusion in the homogenised plant material as described herein are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof. Preferably, the binder may comprise guar gum. The binder may be present in an amount of from about 1 percent to about 10 percent by weight, based on the dry weight of the homogenised plant material, preferably in an amount of from about 2 percent to about 5 percent by weight, based on the dry weight of the homogenised plant material.

The homogenised plant material may comprise one or more lipids to facilitate the diffusivity of volatile components (for example, aerosol formers, eugenol and nicotine). Suitable lipids for inclusion in the homogenised plant material include, but are not limited to: medium-chain triglycerides, cocoa butter, palm oil, palm kernel oil, mango oil, shea butter, soybean oil, cottonseed oil, coconut oil, hydrogenated coconut oil, candellila wax, carnauba wax, shellac, sunflower wax, sunflower oil, rice bran, and Revel A; and combinations thereof.

The homogenised plant material may comprise one or more types of fibers. Suitable fibers for inclusion in the homogenised plant material are known in the art and include fibers formed from non-tobacco material and non-clove material, including but not limited to: cellulose fibers; softwood fibers; hard-wood fibers; jute fibers and combinations thereof. Prior to inclusion in the homogenised plant material, fibers may be treated by suitable processes known in the art including, but not limited to: mechanical pulping; refining; chemical pulping; bleaching; sulfate pulping; and combinations thereof. A fiber typically has a length greater than its width. Suitable fibers typically have lengths of greater than 400 μm and less than or equal to 4 mm, preferably within the range of 0.7 mm to 4 mm. The homogenised plant material may be formed of a combination of particulate plant material and fibers formed from non-tobacco and non-clove material. The weight percentages of non-tobacco and non-clove material are not added to the weight of particulate plant material in determination of the weight percentages based on total weight of particulate plant material.

The homogenised plant material may comprise one or more aerosol formers. Functionally, an aerosol former is a component that may be volatilized and may convey one or more of nicotine and flavourant in an aerosol when the homogenised plant material is heated above the specific volatilization temperature of the aerosol former. An aerosol former may be any suitable compound or mixture of compounds that, in use, facilitates formation of a dense and stable aerosol and is substantially resistant to thermal degradation at the operating temperature of the aerosol-generating article. Different aerosol formers vaporize at different temperatures. Thus, an aerosol former may be chosen based on its ability to remain stable at or around room temperature but volatize at a higher temperature, for example between 40-450° C.

The aerosol former may also have humectant type properties that help maintain a desirable level of moisture in the homogenised plant material. In particular, some aerosol formers are hygroscopic materials that function as a humectant.

Suitable aerosol formers and humectants for inclusion in the homogenised plant material are known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

For example, the homogenised plant material may have an aerosol former content of between about 5% and about 30% by weight on a dry weight basis, such as between about 10% and about 25% by weight on a dry weight basis, or between about 15% and about 20% by weight on a dry weight basis. If the substrate is intended for use in an aerosol-generating article for an electrically-operated aerosol-generating system having a heating element, it may preferably include an aerosol former of greater than 5% to about 30% by weight on a dry weight basis. If the substrate is intended for use in an aerosol-generating article for an electrically-operated aerosol-generating system having a heating element, the aerosol former may preferably be glycerine.

Preferably, the homogenised plant material is in the form of one or more sheets of homogenised plant material.

The one or more sheets as described herein may each individually have a thickness of between 100 μm and 600 μm, preferably between 150 μm and 300 μm, and most preferably between 200 μm and 250 μm. Individual thickness refers to the thickness of the individual sheet, whereas combined thickness refers to the total thickness of all sheets that make up the aerosol-generating substrate. For example, if the aerosol-generating substrate is formed from two individual sheets, then the combined thickness is the sum of the thickness of the two individual sheets or the measured thickness of the two sheets where they are stacked in the aerosol-generating substrate.

The one or more sheets as described herein may each individually have a grammage of between about 100 $g/m^2$ and about 300 $g/m^2$.

The one or more sheets as described herein may each individually have a density of from about 0.3 $g/cm^2$ to about 1.3 $g/cm^3$, and preferably from about 0.7 $g/cm^3$ to about 1.0 $g/cm^3$.

The term "tensile strength" is used throughout the specification to indicate a measure of the force required to stretch a sheet of homogenised plant material until it breaks. More specifically, the tensile strength is the maximum tensile force per unit width that the sheet material will withstand before breaking and is measured in the machine direction or cross direction of the sheet material. It is expressed in units of Newtons per meter of material (N/m). Tests for measuring the tensile strength of a sheet material are well known. A suitable test is described in the 2014 publication of the International Standard ISO 1924-2 entitled "Paper and Board—Determination of Tensile Properties—Part 2: Constant Rate of Elongation Method". Further details of the test method are provided under the heading "Test Methods" herein.

The one or more sheets as described herein may each individually have a tensile strength at peak in a cross direction of from 50 N/m to 400 N/m or preferably from 150 N/m to 350 N/m, normalized to a sheet thickness of 215 μm. The normalization is described with respect to Example 2 herein. The one or more sheets as described herein may each individually have a tensile strength at peak in a machine direction of from 100 N/m to 800 N/m or preferably from 280 N/m to 620 N/m, normalized to a sheet thickness of 215 μm. The machine direction refers to the direction in which the sheet material would be rolled onto or unrolled from a bobbin and fed into a machine, while the cross direction is perpendicular to the machine direction. Such values of tensile strength make sheets and methods described herein particularly suitable for subsequent operations involving mechanical stresses.

The provision of a sheet having the levels of thickness, grammage and tensile strength as defined above advantageously optimises the machinability of the sheet to form the aerosol-generating substrate and ensures that damage, such as tearing of the sheet, is avoided during high speed processing of the sheet.

Preferably the one or more sheets may be in the form of one or more gathered sheets.

The sheet of homogenised plant material may preferably be gathered transversely relative to the longitudinal axis thereof and circumscribed with a wrapper to form a continuous rod or a plug. The continuous rod may be severed into a plurality of discrete rods or plugs. The wrapper may be a paper wrapper or a non-paper wrapper. Suitable paper wrappers for use in specific embodiments of the invention are known in the art and include, but are not limited to: cigarette papers; and filter plug wraps. Suitable non-paper wrappers for use in specific embodiments of the invention are known in the art and include, but are not limited to: homogenised tobacco materials. Homogenised tobacco wrappers are particularly suitable for use in embodiments wherein the aerosol-generating substrate comprises one or more sheets of homogenised plant material formed of particulate plant material, the particulate plant material containing clove particles in combination with a low percentage by weight of tobacco particles, such as from 20 percent to 0 percent by weight of tobacco particles, based on dry weight.

As used herein, the term "gathered" denotes that the sheet of homogenised plant material is convoluted, folded, or otherwise compressed or constricted substantially transversely to the cylindrical axis of a plug or a rod. As used herein, the term "longitudinal" refers to the direction corresponding to the main longitudinal axis of the aerosol-generating article, which extends between the upstream and downstream ends of the aerosol-generating article. During use, air is drawn through the aerosol-generating article in the longitudinal direction. The term "transverse" refers to the direction that is perpendicular to the longitudinal axis. As used herein, the term "length" refers to the dimension of a component in the longitudinal direction and the term "width" refers to the dimension of a component in the transverse direction. For example, in the case of a plug or rod having a circular cross-section, the maximum width corresponds to the diameter of the circle. As used herein, the terms "upstream" and "downstream" describe the relative positions of elements, or portions of elements, of the aerosol-generating article in relation to the direction in which the aerosol is transported through the aerosol-generating article during use. The downstream end of the airflow path is the end at which aerosol is delivered to a user of the article.

The sheet of homogenised plant material may be textured through crimping, embossing, perforating or otherwise texturing prior to gathering or being cut into shreds. Preferably the sheet of homogenised plant material is crimped prior to gathering, such that the homogenised plant material may be in the form of a crimped sheet, more preferably in the form of a gathered crimped sheet. As used herein, the term "crimped sheet" denotes a sheet having a plurality of substantially parallel ridges or corrugations.

Alternatively, the homogenised plant material may be in the form of a plurality of shreds, strands or strips. The shreds, strands or strips may be used to form a plug. As used herein, the term "strand" describes an elongate element of material having a length that is substantially greater than the width and thickness thereof. The term "strand" should be considered to encompass strips, shreds and any other homogenised plant material having a similar form. The strands of homogenised plant material may be formed from a sheet of homogenised plant material, for example by cutting or shredding, or by other methods, for example, by an extrusion method.

In some embodiments, the strands may be formed in situ within the aerosol-generating substrate as a result of the splitting or cracking of a sheet of homogenised plant material during formation of the aerosol-generating substrate, for example, as a result of crimping. The strands of homogenised plant material within the aerosol-generating substrate may be separate from each other. Alternatively, each strand of homogenised plant material within the aerosol-generating substrate may be at least partially connected to an adjacent strand or strands along the length of the strands. For example, adjacent strands may be connected by one or more fibres. This may occur, for example, where the strands have been formed due to the splitting of a sheet of homogenised plant material during production of the aerosol-generating substrate, as described above.

Typically, the width of such shreds, strands or strips is about 5 mm, or about 4 mm, or about 3 mm, or about 2 mm or less. The length of the shreds, strands or strips may be greater than about 5 mm, between about 5 mm to about 15 mm, about 8 mm to about 12 mm, or about 12 mm. The length of the shreds, strands or strips may be determined by the manufacturing process whereby a rod is cut into shorter plugs and the length of the shreds, strands or strips corresponds to the length of the plug. The shreds, strands or strips may be fragile which may result in breakage especially during transit. In such cases, the length of some of the shreds, strands or strips may be less than the length of the plug.

The plurality of strands preferably extend substantially longitudinally along the length of the aerosol-generating substrate, aligned with the longitudinal axis. Preferably, the plurality of strands are therefore aligned substantially parallel to each other. This provides a relatively uniform, regular structure which facilitates the insertion of an internal heater element into the aerosol-generating substrate and optimises the efficiency of heating.

In one embodiment, the substrate may be in the form of a single plug of aerosol-generating substrate. Most preferably, the plug of aerosol-generating substrate may comprise one or more sheets of homogenised plant material. Preferably, the one or more sheets of homogenised plant material may be crimped such that it has a plurality of ridges or corrugations substantially parallel to the cylindrical axis of the plug. This advantageously facilitates gathering of the crimped sheet of homogenised plant material to form the plug. Preferably, the one or more sheets of homogenised plant material may be gathered. It will be appreciated that crimped sheets of homogenised plant material may alternatively or in addition have a plurality of substantially parallel ridges or corrugations disposed at an acute or obtuse angle to the cylindrical axis of the plug. The sheet may be crimped to such an extent that the integrity of the sheet becomes disrupted at the plurality of parallel ridges or corrugations causing separation of the material, and results in the formation of shreds, strands or strips of homogenised plant material.

An aerosol-generating article may comprise the substrate in accordance with the invention. The aerosol-generating article may comprise a rod. The rod may comprise the substrate in accordance with the invention in one or more plugs, and may optionally further comprise one or more filter segments which are combined during manufacturing of the article. When the rod includes optional filter segments, it may have a rod length of from about 5 mm to about 130 mm. When the rod does not include optional filter segments, it may have a length of from about 5 mm to about 120 mm. The rod may comprise one or more plugs of aerosol-generating substrate. When a single plug of aerosol-generating substrate forms the rod, both the rod and the plug preferably have a length of between about 10 and about 40 mm, more preferably between about 10 mm and 15 mm, most preferably about 12 mm. Rods may have a diameter of between about 5 mm and about 10 mm, depending on their intended use.

In a preferred embodiment, the aerosol-generating substrate is in the form of a plug. In a preferred embodiment, the homogenised plant material is in the form of one or more sheets of homogenised plant material. Thus, in a preferred embodiment, the aerosol-generating substrate is in the form of a plug comprising one or more sheets of homogenised plant material formed of particulate plant material, the particulate plant material comprising between 10 percent and 100 percent by weight clove particles and between 0 percent and 90 percent by weight tobacco particles, based on the dry weight of the particulate plant material.

In another embodiment of the aerosol-generating substrate, the homogenised plant material comprises a first homogenised plant material and a second homogenised plant material, wherein the first homogenised plant material is formed of a first particulate plant material, the first particulate plant material comprising between at least 50 percent and 100 percent by weight clove particles, based on dry weight of the first particulate plant material; and wherein the second homogenised plant material is formed of a second particulate plant material, the second particulate plant material comprising between at least 50 percent and 100 percent by weight tobacco particles, based on dry weight of the second particulate plant material. Overall, in accordance with the invention, the particulate plant material comprises between 10 percent and 100 percent by weight clove particles and between 0 percent and 90 percent by weight tobacco particles, based on the dry weight of the particulate plant material.

Optionally, the first particulate plant material may comprise at least 60 percent by weight clove particles and the second particulate plant material may comprise at least 60 percent by weight tobacco particles. Optionally, the first particulate plant material may comprise at least 90 percent by weight clove particles and the second particulate plant material may comprise at least 90 percent by weight tobacco particles. Optionally, the first particulate plant material may comprise at least 95 percent by weight clove particles and the second particulate plant material may comprise at least 95 percent by weight tobacco particles.

In such arrangements, the first homogenised plant material comprises a first particulate plant material with a major proportion of clove particles, while the second homogenised plant material comprises a second particulate plant material with a major proportion of tobacco particles.

Preferably, the first homogenised plant material may be in the form of one or more sheets and the second homogenised plant material may be in the form of one or more sheets.

Optionally, the substrate may comprise one or more plugs. Preferably, the substrate may comprise a first plug and a second plug, wherein the first homogenised plant material may be located in the first plug and the second homogenised plant material may be located in the second plug.

Two or more plugs may be combined in an abutting end-to-end relationship and extend to form a rod. Two plugs may be placed longitudinally with a gap between them, thereby creating a cavity within a rod. The plugs may be in any suitable arrangement within the rod.

For instance, in a preferred arrangement, a downstream plug comprising a major proportion of clove may abut an upstream plug comprising a major proportion of tobacco to form the rod. The alternative configuration in which the upstream and downstream positions of the respective plugs are changed relative to one another is also envisaged. Alternative configurations in which a third homogenised plant material containing either a major proportion of clove or a major proportion of tobacco and forming a third plug are also envisaged. For instance, a plug containing a major proportion of clove by weight may be sandwiched between two plugs each comprising a major proportion of tobacco by weight, or a plug comprising a major proportion of tobacco by weight may be sandwiched between two plugs each comprising a major proportion of clove by weight. Further configurations may be envisaged by the skilled person. Where two or more plugs are provided, the homogenised plant material may be provided in the same form in each plug or in a different form in each plug, that is, gathered or shredded.

The first plug may comprise one or more sheets of the first homogenised plant material, and the second plug may comprise one or more sheets of the second homogenised plant material. The sum of the length of the plugs may be between about 10 mm and about 40 mm, preferably between about 10 and about 15 mm, more preferably about 12 mm. The first plug and the second plug may be of the same length or may have different lengths. If the first plug and the second plug have the same lengths, the length of each plug may be preferably from about 6 mm to about 20 mm. Preferably, the second plug may be longer than the first plug in order to provide a desired ratio of tobacco particles to clove particles in the substrate. Overall within the aerosol-generating substrate in the aerosol-generating article, preferably the particulate plant material contains between 60 percent and 70 percent by weight tobacco particles and between 30 and 40 percent by weight clove particles, on a dry weight basis. Preferably the second plug is at least 40 percent to 50 percent longer than the first plug.

If the first homogenised plant material and the second homogenised plant material are in the form of one or more sheets, preferably the one or more sheets of the first homogenised plant material and second homogenised plant material may be gathered sheets. Preferably the one or more sheets of the first homogenised plant material and second homogenised plant material may be crimped sheets. It will be appreciated that all other physical properties described with reference to an embodiment in which a single homogenised plant material is present are equally applicable to an embodiment in which a first homogenised plant material and a second homogenised plant material are present. Further, it will be appreciated that the description of additives (such as binders, lipids, fibers, aerosol formers, humectants, plasticisers, flavourants, fillers, aqueous and non-aqueous solvents and combinations thereof) with reference to an embodiment in which a single homogenised plant material is present are equally applicable to an embodiment in which a first homogenised plant material and a second homogenised plant material are present.

In yet another embodiment, of the aerosol-generating substrate, the first homogenised plant material is in the form of a first sheet, the second homogenised plant material is in the form of a second sheet, and the second sheet at least partially overlies the first sheet.

The first sheet may be a textured sheet and the second sheet may be non-textured.

Both the first and second sheets may be textured sheets.

The first sheet may be a textured sheet that is textured in a different way to the second sheet. For example, the first sheet may be crimped and the second sheet may be perforated. Alternatively, the first sheet may be perforated and the second sheet may be crimped.

Both the first and second sheets may be crimped sheets that are morphologically different from each other. For example, the second sheet may be crimped with a different number of crimps per unit width of sheet compared to the first sheet.

The sheets may be gathered to form a plug. The sheets that are gathered together to form the plug may have different physical dimensions. The width and thickness of the sheets may be varied.

It may be desirable to gather together two sheets each having a different thickness or each having a different width. This may alter the physical properties of the plug. This may facilitate the formation of a blended plug of aerosol-generating substrate from sheets of different chemical composition.

The first sheet may have a first thickness and the second sheet may have a second thickness that is a multiple of the first thickness, for example the second sheet may have a thickness two or three times the first thickness.

The first sheet may have a first width and the second sheet may have a second width that is different to the first width.

The first sheet and the second sheet may be disposed in overlapping relationship prior to being gathered together, or at the point at which they are gathered together. The sheets may have the same width and thickness. The sheets may have different thicknesses. The sheets may have different widths. The sheets may be differently textured.

Where it is desired that the first sheet and the second sheet are both textured, the sheets may be simultaneously textured prior to being gathered. For example, the sheets may be brought into overlapping relationship and passed through a texturing means, such as a pair of crimping rollers. A suitable apparatus and process for simultaneous crimping are described with reference to FIG. 2 of WO2013/178766. In a preferred embodiment, the second sheet of the second homogenised plant material overlies the first sheet of the first homogenised plant material, and the combined sheets are gathered to form a plug of aerosol-generating substrate. Optionally, the sheets may be crimped together prior to gathering to facilitate gathering.

Alternatively, each sheet may be separately textured and then subsequently brought together to be gathered into a plug. For example, where the two sheets have a different thickness, it may be desirable to crimp the first sheet differently relative to the second sheet.

It will be appreciated that all other physical properties described with reference to an embodiment in which a single homogenised plant material is present are equally applicable to an embodiment in which a first homogenised plant material and a second homogenised plant material are present. Further, it will be appreciated that the description of additives (such as binders, lipids, fibers, aerosol formers, humectants, plasticisers, flavourants, fillers, aqueous and non-aqueous solvents and combinations thereof) with reference to an embodiment in which a single homogenised plant material is present are equally applicable to an embodiment in which a first homogenised plant material and a second homogenised plant material are present.

The aerosol-generating article may comprise a hollow cellulose acetate tube immediately downstream of the aerosol-generating substrate. One function of the tube is to locate the aerosol-generating substrate towards the distal end of the aerosol-generating article so that it can be contacted with a heating element. The tube acts to prevent the aerosol-generating substrate from being forced along the aerosol-generating article towards other downstream elements when a heating element is inserted into the aerosol-generating substrate. The tube also acts as a spacer element to separate the downstream elements from the aerosol-generating substrate.

The aerosol-generating article may comprise one or more of a spacer or an aerosol-cooling element downstream of the aerosol-generating substrate and immediately downstream of the hollow cellulose acetate tube. In use, an aerosol formed by volatile compounds released from the aerosol-generating substrate passes through and is cooled by the aerosol-cooling element before being inhaled by a user. The spacer may be a hollow tube of equal outer diameter but larger inner diameter than the hollow cellulose acetate tube. The spacer or aerosol-cooling element may be made of any suitable material, such as a metallic foil, a paper laminated with a foil, a polymeric sheet, and a substantially non-porous paper or cardboard. In some embodiments, the aerosol-cooling element may comprise one or more sheets made of a material selected from the group consisting of polyethylene (PE), polypropylene (PP), polyvinylchloride (PVC), polyethylene terephthalate (PET), polylactic acid (PLA), cellulose acetate (CA), and aluminium foil. Alternatively, the aerosol-cooling element may be made of woven or non-woven filaments of a material selected from the group consisting of polyethylene (PE), polypropylene (PP), polyvinylchloride (PVC), polyethylene terephthalate (PET), polylactic acid (PLA), and cellulose acetate (CA). In a preferred embodiment, the aerosol-cooling element is a crimped and gathered sheet of polylactic acid wrapped within a filter paper. In another preferred embodiment, the spacer comprises a longitudinal channel and is made of woven polylactic acid filaments wrapped in paper.

The aerosol-generating article may comprise a filter or mouthpiece downstream of the aerosol-generating substrate and the hollow acetate tube, spacer or aerosol-cooling element. The filter may comprise one or more filtration materials for the removal of particulate components, gaseous components or a combination thereof. Suitable filtration materials are known in the art and include, but are not limited to: fibrous filtration materials such as, for example, cellulose acetate tow and paper; adsorbents such as, for example, activated alumina, zeolites, molecular sieves and silica gel; biodegradable polymers including, for example, polylatic acid (PLA), Mater-Bi®, and bioplastics; and combinations thereof. The filter may be located at the downstream end of the aerosol-generating article. The filter may be a cellulose acetate filter plug. The filter is about 7 mm in length in one embodiment, but may have a length of between about 5 mm and about 10 mm.

In one embodiment, the aerosol-generating article has a total length of about 45 mm. The aerosol-generating article may have an external diameter of about 7.3 mm.

The aerosol-generating article may further comprise one or more aerosol-modifying elements. An aerosol-modifying element may provide an aerosol-modifying agent. As used herein, the term aerosol-modifying agent is used to describe any agent that, in use, modifies one or more features or properties of aerosol passing through the filter. Suitable aerosol-modifying agents include, but are not limited to, agents that, in use, impart a taste or aroma to aerosol passing through the filter.

An aerosol-modifying agent may be one or more of moisture or a liquid flavourant. Water or moisture may modify the sensorial experience of the user, for example by moistening the generated aerosol, which may provide a cooling effect on the aerosol and may reduce the perception of harshness experienced by the user. An aerosol-modifying element may be in the form of a flavour-delivery element to deliver one or more liquid flavourants.

The one or more liquid flavourants may comprise any flavour compound or botanical extract suitable for being releasably disposed in liquid form within the flavour-delivery element to enhance the taste of aerosol produced during use of the aerosol-generating article. The flavourants, liquid or solid, can also be disposed directly in the material which forms the filter, such as cellulose acetate tow. Suitable flavours or flavourings include, but are not limited to, menthol, mint, such as peppermint and spearmint, chocolate, liquorice, citrus and other fruit flavours, gamma octalactone, vanillin, ethyl vanillin, breath freshener flavours, spice flavours such as cinnamon, methyl salicylate, linalool, eugenol, bergamot oil, geranium oil, lemon oil, ginger oil, and tobacco flavour. Other suitable flavours may include flavour compounds selected from the group consisting of an acid, an alcohol, an ester, an aldehyde, a ketone, a pyrazine, combinations or blends thereof and the like.

The one or more aerosol-modifying elements may be located downstream of the aerosol-generating substrate or within the aerosol-generating substrate. Typically, aerosol-modifying elements may be located downstream of the aerosol-generating substrate, most typically, within the filter of the aerosol-generating article, such as within a filter plug or within a cavity between filter plugs. The one or more aerosol-modifying elements may be in the form of one or more of a thread, a capsule, a microcapsule, a bead or a polymer matrix material.

If an aerosol-modifying element is in the form of a thread, as described in WO2011/060961, the thread may be formed from paper such as filter plug wrap, and the thread may be loaded with at least one aerosol-modifying agent and located within the body of the filter.

If an aerosol-modifying element is in the form of a capsule, as described in WO2007/010407, WO2013/068100 and WO2014/154887, the capsule may be a breakable capsule located within the filter, the inner core of the capsule containing an aerosol-modifying agent which may be released upon breakage of the outer shell of the capsule when the filter is subjected to external force. The capsule may be located within a filter plug or within a cavity between filter plugs.

If an aerosol-modifying element is in the form of a polymer matrix material, the polymer matrix material releases the flavourant when the aerosol-generating article is heated, such as when the polymer matrix is heated above the melting point of the polymer matrix material as described in WO2013/034488. Typically, such polymer matrix material may be located within a bead within the aerosol-generating substrate. Alternatively, or in addition, the flavourant may be trapped within the domains of a polymer matrix material and releasable from the polymer matrix material upon compression of the polymer matrix material. Such flavour-modifying elements may provide a sustained release of the liquid flavourant over a range of force of at least 5 Newtons, as described in WO2013/068304. Typically, such polymer matrix material may be located within a bead within the filter.

The aerosol-generating article may comprise a combustible heat source and an aerosol-generating substrate downstream of the combustible heat source, the aerosol-generating substrate as described above with respect to the first aspect of the invention.

For example, substrates as described herein may be used in heated aerosol-generating articles of the type disclosed in WO-A-2009/022232, which comprise a combustible carbon-based heat source, an aerosol-generating substrate downstream of the combustible heat source, and a heat-conducting element around and in contact with a rear portion of the combustible carbon-based heat source and an adjacent front portion of the aerosol-generating substrate. However, it will be appreciated that substrates as described herein may also be used in heated aerosol-generating articles comprising combustible heat sources having other constructions.

According to a second aspect, the present invention provides an aerosol-generating system comprising an aerosol-generating device comprising a heating element and an aerosol-generating article for use with the aerosol-generating device, the aerosol-generating article comprising the aerosol-generating substrate as described above with respect to the first aspect of the invention.

In a preferred embodiment, aerosol-generating substrates as described herein may be used in heated aerosol-generating articles for use in electrically-operated aerosol-generating systems in which the aerosol-generating substrate of the heated aerosol-generating article is heated by an electrical heat source.

For example, aerosol-generating substrates as described herein may be used in heated aerosol-generating articles of the type disclosed in EP-A-0 822 760.

The heating element of such heated aerosol-generating articles may be of any suitable form to conduct heat. The heating of the aerosol-generating substrate may be achieved internally, externally or both. The heating element may preferably be a heater blade or pin adapted to be inserted into the substrate so that the substrate is heated from inside. Alternatively, the heating element may partially or completely surround the substrate and heat the substrate from the outside.

In another aspect, the present invention comprises a method of making a homogenised plant material for use as an aerosol-generating substrate in a heated aerosol-generating article. To form homogenised plant material, a mixture comprising particulate plant material, water and an aerosol former is formed. The particulate plant material and aerosol former are both as described above with reference to the first aspect of the invention. A sheet is formed from the mixture, and the sheet is then dried.

Preferably the mixture is an aqueous mixture. The mixture may be a homogenised mixture. As used herein, "dry weight base" refers to the weight of a particular non-water component relative to the sum of the weights of all non-water components in a mixture, expressed as a percentage. The composition of aqueous mixtures may be referred to by "percentage dry weight." This refers to the weight of the non-water components relative to the weight of the entire aqueous mixture, expressed as a percentage.

The mixture may be a slurry. As used herein, a "slurry" is a homogenised aqueous mixture with a relatively low dry weight. A slurry as used in the method herein may preferably have a dry weight of between 5 percent and 60 percent.

Alternatively, the mixture may be a dough. As used herein, a "dough" is an aqueous mixture with a relatively high dry weight. A dough as used in the method herein may preferably have a dry weight of at least 60 percent, more preferably at least 70 percent.

The mixture is first produced by mixing particulate plant material, water and an aerosol former. Optionally, the mixture may also include a binder. Optionally, the mixture may also include fibers. Optionally, the mixture may also include one or more nicotine salts. For mixtures of a low viscosity, that is, some slurries, it is preferred that mixing is performed using a high energy mixer or a high shear mixer. Such mixing breaks down and distributes the various phases of the mixture homogeneously. For mixtures of a higher viscosity, that is, some doughs, a kneading process may be used to distribute the various phases of the mixture homogeneously.

The method may further comprise the step of vibrating the mixture to distribute the various components. Vibrating the mixture, that is for example vibrating a tank or silo where a homogenised mixture is present, may help the homogenization of the mixture, particularly when the mixture is a mixture of low viscosity, that is, some slurries. Less mixing time may be required to homogenize a mixture to the target value optimal for casting if vibrating is performed as well as mixing.

If the mixture is a slurry, a web of homogenised plant material is preferably formed by a casting process comprising casting the slurry on a supportive surface, such as a belt conveyor. The method for production of a homogenised plant material comprises the step of drying said cast web to form a sheet. The cast web may be dried at room temperature or at an ambient temperature of between 80 and 160 degrees Celsius for a suitable length of time. Preferably, the moisture content of the sheet after drying is between about 5 percent and about 15 percent based on the total weight of the sheet. The sheet may then be removed from the supportive surface after drying. The cast sheet has a tensile strength such that it can be mechanically manipulated and wound or unwound from a bobbin without breakage or deformation.

If the homogenised mixture is a dough, the dough may be extruded in the form of a sheet, strands, or strips, prior to the step of drying the extruded mixture. Preferably, the dough may be extruded in the form of a sheet. The extruded mixture may be dried at room temperature or at an ambient temperature of between 80 and 160 degrees Celsius for a suitable length of time. Preferably, the moisture content of the extruded mixture after drying is between about 5 percent and about 15 percent based on the total weight of the sheet. A sheet formed from dough requires less drying time and/or lower drying temperatures as a result of significantly lower water content relative to a web formed from a slurry.

After the sheet has been dried, the method may optionally comprise a step of coating a nicotine salt, preferably along with an aerosol former, onto the sheet, as described in the disclosure of WO2015/082652.

After the sheet has been dried, the method may optionally comprise a step of cutting the sheet into shreds, strands or strips.

After the sheet has been dried, the method may optionally comprise a further step of winding the sheet onto a bobbin.

Slurries comprising greater than 30 percent dry weight and doughs may be preferred in the present method. Preliminary data suggest that losses of eugenol, the compound primarily responsible for clove flavour, may be reduced by at least 10% in comparison to slurries comprising less than 30 percent dry weight. A higher eugenol content may thus be retained when a higher dry weight is used, as less eugenol is volatilised and lost in the drying process.

Surprisingly, it has also been found that aerosol generated from the heated aerosol-generating articles in accordance with the invention contains reduced levels of acrylamide, catechol, hydroquinone, phenol, isoprene and acetaldehyde when compared to the aerosol from similar articles produced using the same homogenised tobacco blends but without added clove. This is further detailed in Example 2. Furthermore, it has also been found that, relative to comparable density sheets comprising 100% tobacco particles, homogenised sheets comprising clove particles as described herein exhibit tensile strengths at peak in both the cross direction and the machine direction that are higher than the reference ranges for 100% tobacco cast-leaf sheets. This is further detailed in Example 3.

Specific embodiments will be further described, by way of example only, with reference to the accompanying drawings in which.

Figure 4A:
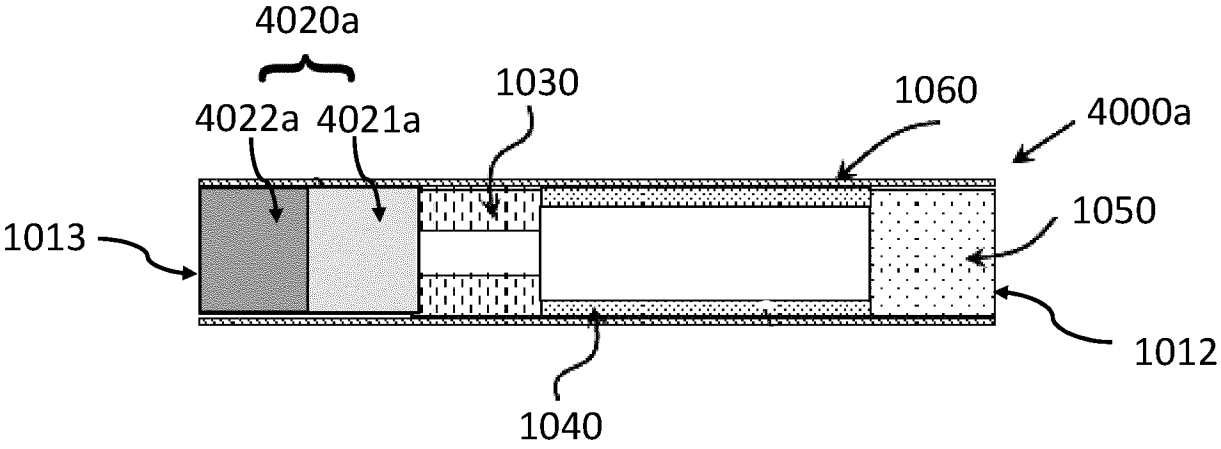
Figure 4B:
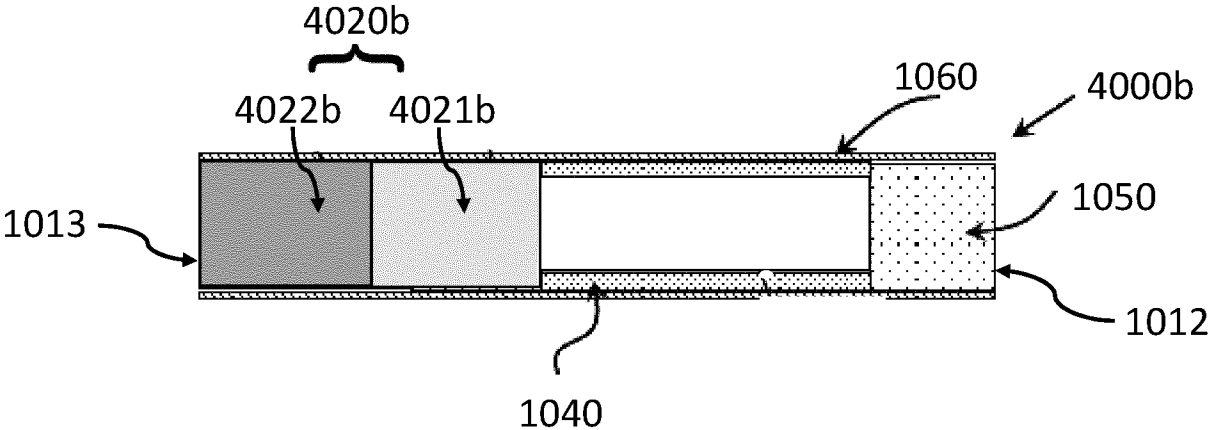
Figure 5:
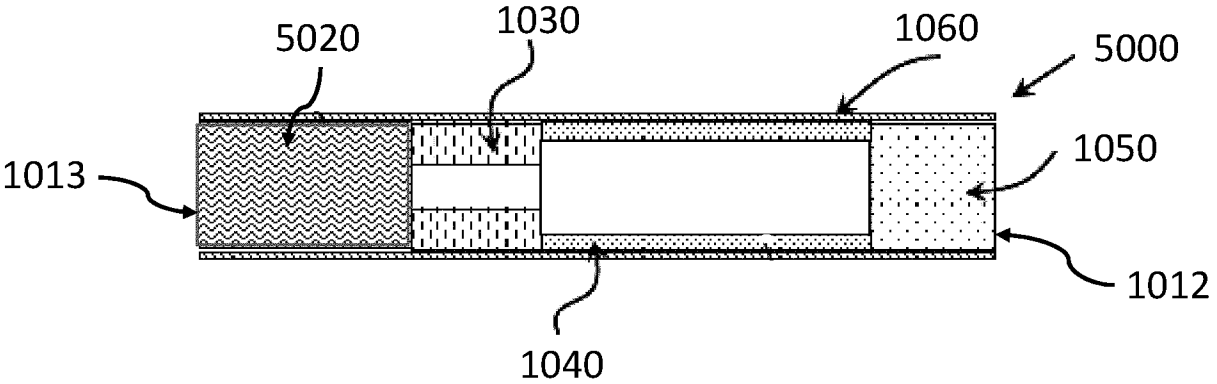

FIGS. 4*a* and 4*b* illustrate a second embodiment of a substrate of an aerosol-generating article as described herein; and FIG. 5 illustrates a third embodiment of a substrate of an aerosol-generating article as described herein.

Figure 6B:
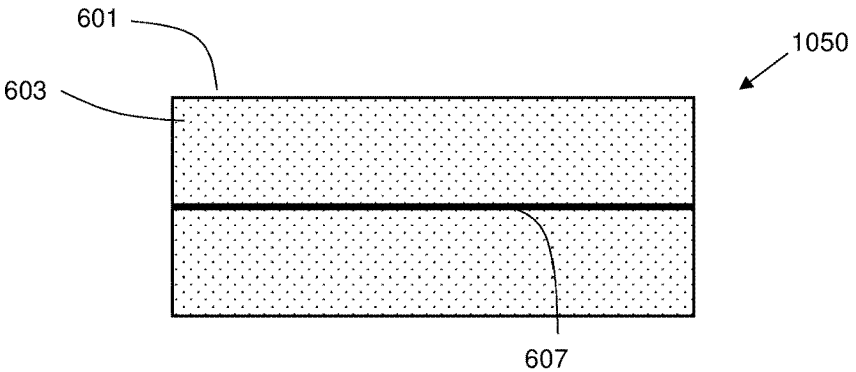
Figure 6A:
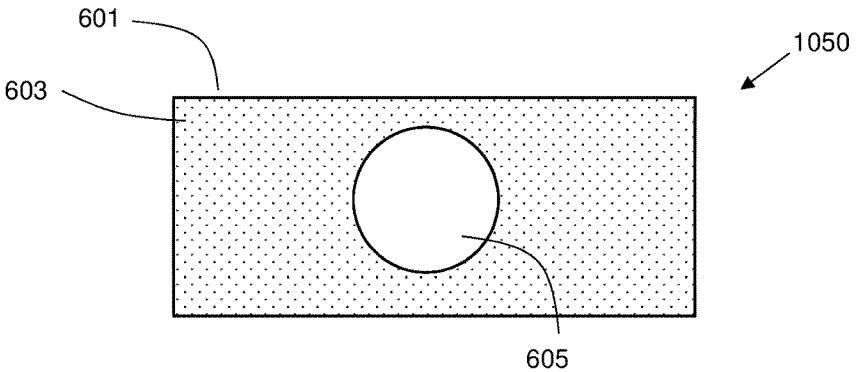

FIG. 6 is a cross sectional view of filter 1050 further comprising an aerosol-modifying element, wherein FIG. 6*a* illustrates the aerosol-modifying element in the form of a spherical capsule or bead within a filter plug.

FIG. 6*b* illustrates the aerosol-modifying element in the form of a thread within a filter plug.

Figure 6C:
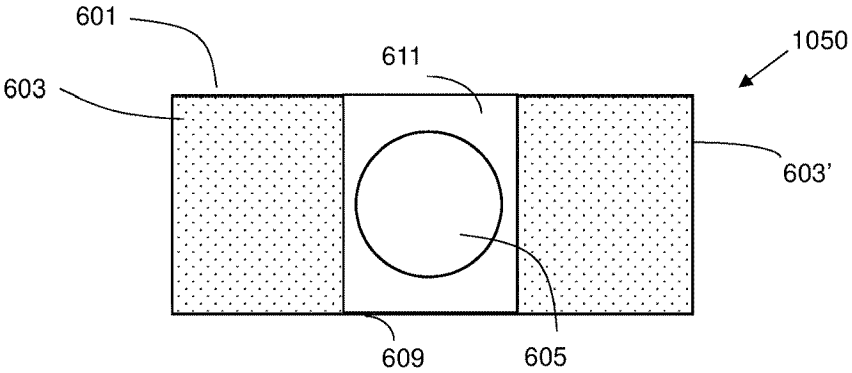

FIG. 6*c* illustrates the aerosol-modifying element in the form of a spherical capsule within a cavity within the filter.

Figure 7:
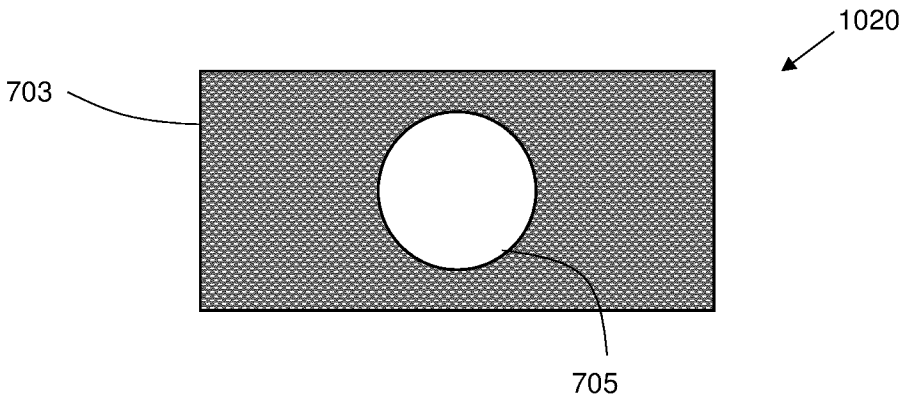

FIG. 7 is a cross sectional view of a plug of aerosol-generating substrate 1020 further comprising an aerosol-modifying element in the form of a bead.

FIG. 8 illustrates the measuring principle and the relevant dimensions of the test specimen before and during stretching in the Dry Tensile Strength test described herein.

FIG. 9 illustrates a typical force/elongation curve obtained for a single test specimen and the relevant formulae for calculating the tensile strength and stretch at break.

Figure 1:
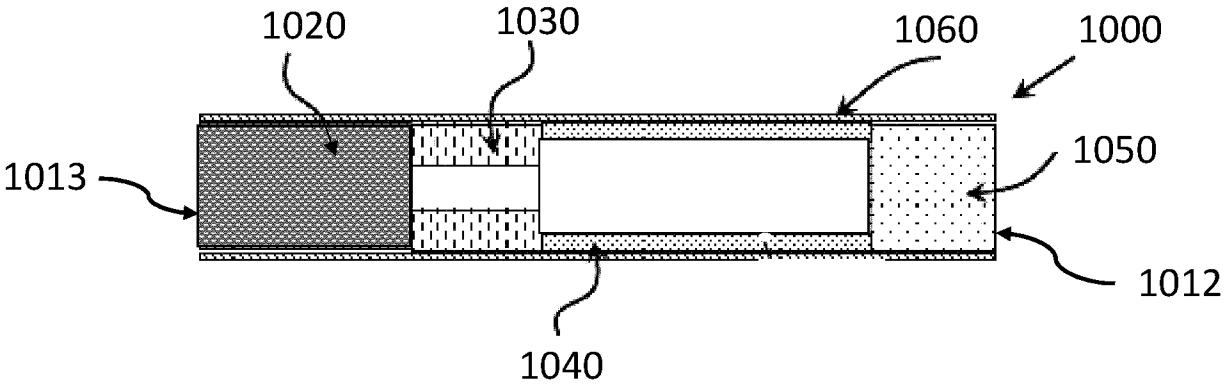
FIG. 1 illustrates a first embodiment of a substrate of an aerosol-generating article as described herein.

FIG. 1 illustrates a heated aerosol-generating article 1000 comprising a substrate as described herein. The article 1000 comprises four elements; the aerosol-generating substrate 1020, a hollow cellulose acetate tube 1030, a spacer element 1040, and a mouthpiece filter 1050. These four elements are arranged sequentially and in coaxial alignment and are assembled by a cigarette paper 1060 to form the aerosol-generating article 1000. The article 1000 has a mouth-end 1012, which a user inserts into his or her mouth during use, and a distal end 1013 located at the opposite end of the article to the mouth end 1012. The embodiment of an aerosol-generating article illustrated in FIG. 1 is particularly suitable for use with an electrically-operated aerosol-generating device comprising a heater for heating the aerosol-generating substrate.

When assembled, the article 1000 is about 45 millimetres in length and has an outer diameter of about 7.2 millimetres and an inner diameter of about 6.9 millimetres.

The aerosol-generating substrate 1020 comprises a plug formed from a sheet of homogenised plant material formed comprising tobacco particles and clove particles. The sheet is gathered, crimped and wrapped in a filter paper (not shown) to form the plug. The sheet includes additives, including glycerine as an aerosol-forming additive.

An aerosol-generating article 1000 as illustrated in FIG. 1 is designed to engage with an aerosol-generating device in order to be consumed. Such an aerosol-generating device includes means for heating the aerosol-generating substrate 1020 to a sufficient temperature to form an aerosol. Typically, the aerosol-generating device may comprise a heating element that surrounds the aerosol-generating article 1000 adjacent to the aerosol-generating substrate 1020, or a heating element that is inserted into the aerosol-generating substrate 1020.

Once engaged with an aerosol-generating device, a user draws on the mouth-end 1012 of the smoking article 1000 and the aerosol-generating substrate 1020 is heated to a temperature of about 375 degrees Celsius. At this temperature, volatile compounds are evolved from the aerosol-generating substrate 1020. These compounds condense to form an aerosol. The aerosol is drawn through the filter 1050 and into the user's mouth.

Figure 2:
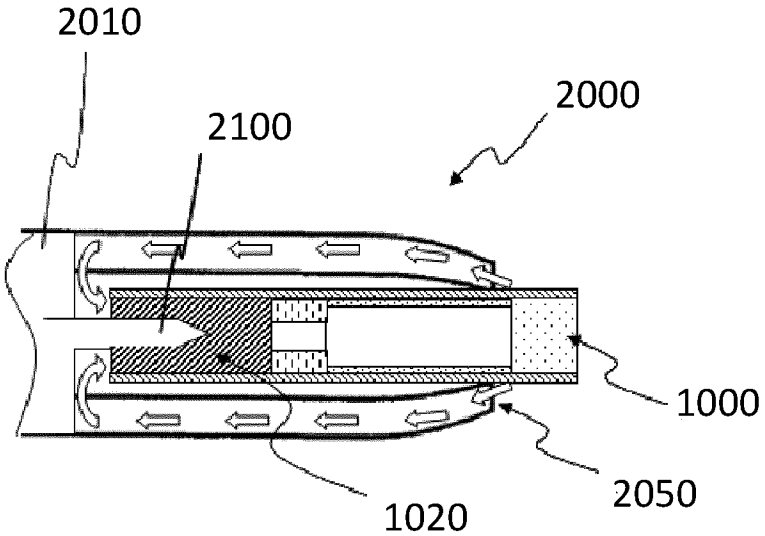
FIG. 2 illustrates an aerosol-generating system comprising an aerosol-generating article and an aerosol-generating device comprising an electric heating element.

FIG. 2 illustrates a portion of an electrically-operated aerosol-generating system 2000 that utilises a heating blade 2100 to heat an aerosol-generating substrate 1020 of an aerosol-generating article 1000. The heating blade is mounted within an aerosol article receiving chamber of an electrically-operated aerosol-generating device 2010. The aerosol-generating device defines a plurality of air holes 2050 for allowing air to flow to the aerosol-generating article 1000. Air flow is indicated by arrows on FIG. 2. The aerosol-generating device comprises a power supply and electronics, which are not illustrated in FIG. 2. The aerosol-generating article 1000 of FIG. 2 is as described in relation to FIG. 1.

Figure 3:
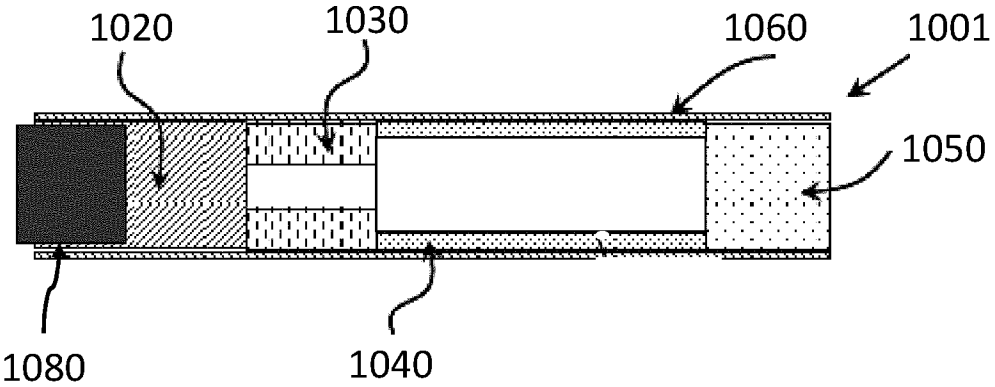
FIG. 3 illustrates an aerosol-generating system comprising an aerosol-generating article and an aerosol-generating device comprising a combustible heating element.

In an alternative configuration shown in FIG. 3, the aerosol-generating system is shown with a combustible heating element. While the article 1000 of FIG. 1 is intended to be consumed in conjunction with an aerosol-generating device, the article 1001 of FIG. 3 comprises a combustible heat source 1080 that may be ignited and transfer heat to the aerosol-generating substrate 1020 to form an inhalable aerosol. The combustible heat source 80 is a charcoal element that is assembled in proximity to the aerosol-generating substrate at a distal end 13 of the rod 11. Elements that are essentially the same as elements in FIG. 1 have been given the same numbering.

FIGS. 4*a* and 4*b* illustrate a second embodiment of a heated aerosol-generating article 4000*a*, 4000*b*. The aerosol-generating substrate 4020*a*, 4020*b* comprises a first downstream plug 4021 formed from of particulate plant material comprising primarily clove particles, and a second upstream plug 4022 formed from particulate plant material comprising primarily tobacco particles. The homogenised plant material is in the form of sheets, which are crimped and wrapped in a filter paper (not shown). The sheets both include additives, including glycerine as an aerosol-forming additive. In the embodiment shown in FIG. 4*a*, the plugs are combined in an abutting end to end relationship to form the rod and are of equal length of about 6 mm each. In a more preferred embodiment (not shown), the second plug is preferably longer than the first plug, for example, preferably 2 mm longer, more preferably 3 mm longer, such that the second plug is 7 or 7.5 mm in length while the first plug is 5 or 4.5 mm in length, to provide a desired ratio of tobacco to clove particles in the substrate. In FIG. 4*b*, the cellulose acetate tube support element 1030 has been omitted.

The article 4000*a*, 4000*b*, analogously to the article 1000 in FIG. 1, is particularly suitable for use with the electrically-operated aerosol-generating system 2000 comprising a heater shown in FIG. 2. Elements that are essentially the same elements in FIG. 1 have been given the same numbering. It may be envisaged by the skilled person that a combustible heat source (not shown) may be instead be used with the second embodiment in lieu of the electrical heating element, in a configuration similar to the configuration containing combustible heat source 1080 in article 1001 of FIG. 3.

FIG. 5 illustrates a third embodiment of a heated aerosol-generating article 5000. The aerosol-generating substrate 5020 comprises a rod formed from a first sheet of homogenised plant material formed of particulate plant material comprising primarily clove particles, and a second sheet of homogenised plant material comprising primarily cast-leaf tobacco. The second sheet overlies the first sheet, and the combined sheets have been crimped, gathered and at least partially wrapped in a filter paper (not shown) to form a plug that is part of the rod. Both sheets include additives, including glycerine as an aerosol-forming additive. The article 5000, analogously to the article 1000 in FIG. 1, is particularly suitable for use with the electrically-operated aerosol-generating system 2000 comprising a heater shown in FIG. 2. Elements that are essentially the same elements in FIG. 1 have been given the same numbering. It may be envisaged by the skilled person that a combustible heat source (not shown) may be instead be used with the third embodiment in lieu of the electrical heating element, in a configuration similar to the configuration containing combustible heat source 1080 in article 1001 of FIG. 3.

FIG. 6 is a cross sectional view of filter 1050 further comprising an aerosol-modifying element. In FIG. 6*a*, the filter 1050 further comprises an aerosol-modifying element in the form of a spherical capsule or bead 605.

In the embodiment of FIG. 6*a*, the capsule or bead 605 is embedded in the filter segment 601 and is surrounded on all sides by the filter material 603. In this embodiment, the capsule comprises an outer shell and an inner core, and the inner core contains a liquid flavourant. The liquid flavourant is for flavouring aerosol during use of the aerosol-generating article provided with the filter. The capsule 605 releases at least a portion of the liquid flavourant when the filter is subjected to external force, for example by squeezing by a consumer. In the embodiment shown, the capsule is generally spherical, with a substantially continuous outer shell containing the liquid flavourant.

In the embodiment of FIG. 6*b*, the filter segment 601 comprises a plug of filter material 603 and a central flavour-bearing thread 607 that extends axially through the plug of filter material 603 parallel to the longitudinal axis of the filter 1050. The central flavour-bearing thread 607 is of substantially the same length as the plug of filter material 603, so that the ends of the central flavour-bearing thread 607 are visible at the ends of the filter segment 601. In FIG. 6*b*, filter material 603 is cellulose acetate tow. The central flavour-bearing thread 607 is formed from twisted filter plug wrap and loaded with an aerosol-modifying agent.

In the embodiment of FIG. 6*c*, the filter segment 601 comprises more than one plug of filter material 603, 603'. Preferably, the plugs of filter material 603, 603' are formed from cellulose acetate, such that they are able to filter the aerosol provided by the aerosol generating article. A wrapper 609 is wrapped around and connects filter plugs 603, 603'. Inside a cavity 611 is a capsule 605 comprising an outer shell and an inner core, and the inner core contains a liquid flavourant. The capsule is otherwise similar to the embodiment of FIG. 6*a*.

FIG. 7 is a cross sectional view of aerosol-generating substrate 1020 further comprising an aerosol-modifying element in the form of a bead 705. The aerosol-generating substrate 1020 comprises a plug 703 formed from a sheet of homogenised plant material comprising tobacco particles and clove particles. The flavour delivery material in the bead 705 incorporates a flavourant which is released upon heating the material to a temperature above 220° C. The flavourant is therefore released into the aerosol as a portion of the plug is heated during use.

Test Methods

Dry Tensile Strength Test

The Dry Tensile Strength Test (ISO 1924-2) measures the tensile strength of a sheet of homogenised plant material conditioned under dry conditions. Tensile strength is a measure of the maximum tensile force per unit width that a sheet will withstand before breaking under the conditions defined in this standard.

Material and Equipment:

- Universal Tensile/Compression Testing Machine, Instron 5566, or equivalent
- Tension load cell of 100 Newtons, Instron, or equivalent
- Two pneumatic action grips
- A steel gauge block of 180±0.25 millimetres length (width: ~10 millimetres, thickness: ~3 millimetres)
- Double-bladed strip cutter, size 15±0.05×~250 millimetres, Adamel Lhomargy, or equivalent
- Scalpel
- Computer running acquisition software, Merlin, or equivalent
- Compressed air Sample Preparation:

- Condition the sheet of homogenised plant material for at least 24 hours at 22±2 degrees Celsius and 60±5% relative humidity before testing.
- Cut machine direction or cross direction sample to the following dimensions: ~250×15±0.1 millimetres with the double-bladed strip cutter. The edges of the test pieces must be cut cleanly—do not cut more than three test specimens at the same time Setting Up of the Instrument:

- Install the tension load cell of 100 Newtons
- Switch on the Universal Tensile/Compression Testing Machine and the computer
- Select the measurement method predefined in the software (test speed set to 8 millimetres per minute)
- Calibrate the tension load cell
- Install the pneumatic action grips
- Adjust the test distance between the pneumatic action grips to 180±0.5 millimetres by means of the steel gauge block
- Set the distance and the force to zero Testing Procedure:

- Place the test specimen straight and centrally between the grips, avoid touching the area to be tested with fingers.
- Close the upper grip and let the paper strip hang in the opened lower grip.
- Set the force to zero.
- Pull down lightly on the paper strip, and then close the lower grip by maintaining the force on the test specimen—the starting force must be between 0.05 and 0.20 Newtons.
- Start the measurement. While the grip is moving upward, a gradually increasing force is applied until the test specimen breaks.
- Repeat the same procedure with the remaining test specimens.

Note: The result is valid when the test specimen breaks at a distance of more than 10 millimetres from the grips. If it is not the case, reject this result and perform an additional measurement.

FIG. 8 illustrates the measuring principle and the relevant dimensions of the test specimen before the test and when stretched during the test.

FIG. 9 illustrates a typical force/elongation curve obtained for a single test specimen and the relevant formulae for calculating the tensile strength and stretch at break.

EXAMPLE 1

Rods having a diameter of about 7 mm, comprising a plug of aerosol-generating substrate and circumscribed by a paper wrapper were prepared. The plug having a length of about 12 mm comprises a crimped sheet of homogenised plant material formed of particulate plant material. The rods having an overall length of about 45 mm also comprise at the mouth end, a cellulose acetate filter (about 7 mm long), followed by a crimped sheet of polylactic acid (about 18 mm long) and then a hollow acetate tube (about 8 mm long) which is adjacent to the plug of aerosol-generating substrate.

Aqueous slurries were prepared with the following content in accordance with Table 1. The particulate plant material in all samples accounted for 76.1% of the dry weight of the homogenised plant material, with glycerin, guar gum and cellulose fibers accounting for the remaining 23.9% of the dry weight of homogenised plant material. In the table below, % DWB refers to the "dry weight base," in this case, the percent by weight calculated relative to the dry weight of the homogenised plant material. The D90 of the particulate plant material was 120 μm.

TABLE 1

| Dry content of slurries | | | | | | |
|---|---|---|---|---|---|---|
| Sample | Clove powder (% DWB) | Kasturi tobacco (% DWB) | Flue-cured tobacco (% DWB) | Glycerin (% DWB) | Guar Gum (% DWB) | Cellulose fibers (% DWB) |
| A | 22.83 | 35.77 | 17.50 | 17.7 | 2.3 | 3.9 |
| B | 30.44 | 30.44 | 15.22 | 17.7 | 2.3 | 3.9 |
| C | 38.05 | 25.11 | 12.94 | 17.7 | 2.3 | 3.9 |
| D | 30.44 | 15.22 | 30.44 | 17.7 | 2.3 | 3.9 |

In this example, two types of tobacco were used, Kasturi and flue-cured tobacco respectively. The clove powder has a eugenol content of about 110 mg/g. The slurries were casted using a casting bar (0.6 mm) on a glass plate, dried in an oven at 140° C. for 7 minutes, and then dried in a second oven at 120° C. for 30 seconds.

Each plug was produced from a single continuous sheet of homogenised plant material, the sheets each having widths of between 100 mm to 125 mm. The individual sheets had thickness of about 220 μm and a grammage of about 200 g/m$^2$. The cut width of each sheet was adapted based on the thickness of each sheet to produce rods of comparable volume. The sheets were crimped to a height of 165 μm to 170 μm, and rolled into plugs having a length of 12 mm and diameters of between 6.9 mm and 7.2 mm, circumscribed by a paper wrapper. The plug was inserted manually into a pre-assembled rod next to the hollow acetate tube further from the mouth end. Regular tipping paper was applied.

The aerosol-generating articles were tested by product developers with experience in smoking Kretek cigarettes using the commercially available iQOS® heat-not-burn device from Philip Morris International. The results of the sensorial assessment are given in Table 2 below.

TABLE 2

| Sensorial assessment | | | | |
|---|---|---|---|---|
| Sample | A | B | C | D |
| Ranking (panelist 1) | 4 | 1 | 3 | 2 |
| Ranking (panelist 2) | 4 | 3 | 1 | 2 |
| Comments (panelist 1) | Good smoke volume<br>Medium clove aroma<br>Medium dark tobacco<br>Imbalanced<br>High impact | Slightly higher clove aroma<br>Slightly higher bright-nutty note<br>Medium dark tobacco<br>Balanced<br>High impact | Lower smoke volume<br>Higher bright-nutty note<br>Medium dark tobacco<br>High impact | Highest clove taste & aroma<br>Medium smoke volume<br>Imbalance between tobacco & clove<br>High impact |
| Comments (panelist 2) | Slight clove spicy note<br>More pronounced clove aroma<br>Quite stable<br>Creamy direction<br>Salivating<br>Very low harshness | Pronounced clove taste, but not so much spicy sensation<br>A bit too sweet<br>Herbal direction<br>Salivating<br>No harshness | Less sweet<br>Most balanced<br>Some biting/numbing sensation<br>Salivating<br>Very low harshness | Very smooth<br>Most Kretek-like<br>No harshness |

A clove inclusion of about 30% dry weight base was preferred by both panelists, while about 23% in Sample A was found to provide insufficient clove aroma. About 30% dry weight base of clove in the substrate corresponds to about 40% by dry weight of clove in the particulate plant material, the particulate plant material containing clove powder and tobacco powder.

The results from the sensorial assessment in Table 2 demonstrate that the inclusion of clove particles in the sheet of homogenised plant material enables a sensorial experience that is close to that of a conventional Kretek cigarette.

EXAMPLE 2

Rods having a diameter of about 7 mm, comprising a plug of aerosol-generating substrate and circumscribed by a paper wrapper were prepared as described in Example 1. The plug having a length of about 12 mm comprises a crimped sheet of homogenised plant material formed of particulate plant material. The rods having an overall length of about 45 mm also comprise at the mouth end, a cellulose acetate filter (about 7 mm long), followed by a crimped sheet of polylactic acid (about 18 mm long) and then a hollow acetate tube (about 8 mm long) which is adjacent to the plug of aerosol-generating substrate.

Comparative sample E is a control plug produced from a continuous sheet of homogenised tobacco material and does not contain clove. This sheet was produced by a casting process from an aqueous slurry (25% dry weight), the sheet having a width of 132 mm, a thickness of 215 μm, a grammage of 202 g/m$^2$ and a moisture content of between 11 and 12%. The continuous sheet comprised about 76.1% dry weight base of tobacco material, 17.7% by dry weight base of glycerine, 2.3% by dry weight base of guar gum, and 3.9% by dry weight base of cellulose fibers, based on the dry weight of the homogenised plant material. The tobacco powder was a blend consisting of 66.6% by weight flue-cured tobacco and 33.3% by weight Indonesian Kasturi tobacco, with a nicotine content of 3.8% by dry weight base.

A mixture was prepared using 45% dry weight base tobacco powder and 30% dry weight base clove powder (both based on the dry weight of the homogenised plant material). The tobacco particles had a D95 value equal to 55 μm, while the clove particles had a D90 value equal to 60 μm. The mixture was used in a casting process to produce a continuous sheet of homogenised plant material to produce the rod in Sample F. The tobacco powder had the same tobacco blend and nicotine content as Comparative sample E. The continuous sheet also comprised about 17.7% by dry weight base of glycerine, 2.3% by dry weight base of guar gum, and 3.9% by dry weight base of cellulose fibers, based on the dry weight of the homogenised plant material. The continuous sheet was produced by a casting process from an aqueous slurry, the sheet having a width of 125 mm and a thickness of 270 μm. The width of the sheet was reduced to achieve a similar volume as the control plug in Comparative sample E, due to the increase in thickness of the sheet.

The aerosol-generating articles were tested using the commercially available iQOS® heat-not-burn device from Philip Morris International.

The content of various compounds in aerosol per group of five puffs of the aerosol-generating articles of Comparative sample E and Sample F is measured under a Health Canada smoking regime over 30 puffs with a puff volume of 55 ml, puff duration of 2 seconds and a puff interval of 30 seconds. See ISO/TR 19478. Each group of five puffs is collected on a Cambridge filter pad and then extracted with a liquid solvent. The resulting liquid is analysed by gas chromatography to determine the content of the aerosol. Three replicates were performed and a standard deviation is reported for each value. The results are shown in Table 3.

TABLE 3

Content of Various Compounds in Aerosol

| Aerosol Constituent | Comparative Sample E | Sample F | Reduction (%) |
|---|---|---|---|
| Acrylamide (μg/cig) | 1.93 ± 0.05 | 1.13 ± 0.03 | 42 |
| Catechol (μg/cig) | 13.2 ± 0.91 | 9.79 ± 0.68 | 26 |
| Hydroquinone (μg/cig) | 5.87 ± 0.31 | 4.39 ± 0.35 | 25 |
| Phenol (μg/cig) | 1.65 ± 0.10 | 1.34 ± 0.22 | 19 |
| Isoprene (μg/cig) | 1.94 ± 0.40 | 1.38 ± 0.08 | 29 |
| Acetaldehyde (μg/cig) | 200 ± 2.96 | 159 ± 13.0 | 20 |
| Nicotine (μg/cig) | 1.86 ± 0.04 | 1.13 ± 0.05 | — |
| Glycerine (μg/cig) | 5.23 ± 0.08 | 4.99 ± 0.41 | — |
| Eugenol (μg/cig) | — | 0.33 | |

As shown in Table 3, the aerosol produced by Sample F containing clove powder results in reduced levels of acrylamide, catechol, hydroquinone, phenol, isoprene and acetaldehyde when compared to the level of the aerosol in Comparative sample E produced using the same tobacco blend but without adding clove. This observed reduction of phenol and catechol is particularly unexpected since a previous study comparing the aerosol chemistry of a conventional tobacco cigarette with that of Kretek cigarettes containing 31 to 33% clove by weight found higher levels of these compounds in the clove-containing cigarettes (Piade et al., Regul. Toxicol. Pharmacol. 2014, 70 S15-S25).

EXAMPLE 3

Comparative Example

A homogenised particulate tobacco sheet was prepared according to a conventional cast leaf process with the following composition:

100% by weight of the particulate plant material as particulate tobacco material. 76.1% by weight tobacco particles, 2.3% by weight guar gum, 17.7% by weight glycerine and 3.9% by weight cellulosic fibers, based on dry weight of the substrate.

The dry tobacco material was fed to a grinder where it was dry ground and screened and subsequently contacted with an aqueous medium including guar as the binder in a high-shear mixer to form a tobacco slurry. The tobacco slurry was then cast onto a moving endless belt. The cast slurry was subsequently passed through a drying assembly to remove moisture so as to form a cast leaf sheet. Finally, the sheet was removed from the belt with a doctor blade.

The 100% tobacco cast leaf sheet obtained had the properties given for Sample No. 1 in Table 4 below.

EXAMPLES

A homogenised particulate plant material sheet was prepared from clove particles or clove particles and tobacco particles according to a cast leaf process in accordance with the invention. The samples had the following compositions:

76.1% by weight particulate plant material, 2.3% by weight guar gum, 17.7% by weight glycerine and 3.9% by weight cellulosic fibers, based on dry weight of the substrate.

The percentages by weight of the clove particles based on the dry weight of the particulate plant material are given in Table 4 below. The balance of the weight of particulate plant material was made up by different blends of particulate tobacco.

The particulate plant material was fed to a grinder where it was dry ground into particles and screened and subsequently contacted with an aqueous medium including guar as the binder in a high-shear mixer to form a slurry. The slurry was then cast onto a moving endless belt. The cast slurry was subsequently passed through a drying assembly to remove moisture so as to form a sheet. Finally, the sheet was removed from the belt with a doctor blade.

The sheets obtained had the properties given for Sample Nos. 2 through 8 in Table 4. To normalize the tensile strength values (that is, Fmax and Δ I in both directions), the actual tensile strength values and the corresponding thickness are used to calculate the tensile strength values for a sheet that is 215 micrometers thick. The following formula is used:

$$\text{Normalized value} = \text{actual value} * 215 / \text{actual thickness}$$

TABLE 4

| Physical properties of sheets | | | | | | | | |
|---|---|---|---|---|---|---|---|---|
| Sample No. | | Grammage ($g/cm^2$) | Thickness (μm) | Density ($g/cm^3$) | CD $F_{at\ peak}$ (N/m) | CD $\Delta l_{at\ peak}$ | MD $F_{at\ peak}$ (N/m) | MD $\Delta l_{at\ peak}$ |
| | | | | | Values normalised to a thickness of 215 μm | | | |
| 1 | Comparative Sample - 100% tobacco | 175.2 | 200.9 | 0.87 | 144 | 0.015 | 203 | 0.025 |
| 2 | 100% clove | 200.2 | 261.8 | 0.77 | 279 | 0.022 | 596 | 0.049 |
| 3 | Tobacco blend 1 with 30% clove | 204.6 | 235.4 | 0.87 | 176 | 0.019 | 332 | 0.043 |
| 4 | Tobacco blend 1 with 40% clove | 202.2 | 245.0 | 0.83 | 187 | 0.020 | 395 | 0.044 |
| 5 | Tobacco blend 1 with 50% clove | 203.7 | 249.7 | 0.82 | 214 | 0.019 | 355 | 0.040 |
| 6 | Tobacco blend 2 with 30% clove | 200.2 | 239.0 | 0.84 | 197 | 0.015 | 296 | 0.032 |
| 7 | Tobacco blend 2 with 40% clove | 196.7 | 239.8 | 0.82 | 211 | 0.016 | 360 | 0.039 |
| 8 | Tobacco blend 2 with 50% clove | 208.7 | 251.0 | 0.83 | 208 | 0.016 | 366 | 0.035 |

Values listed for Sample 2 are an average of values obtained from two 100% clove samples.

In Table 4, "MD" refers to machine direction, that is, the direction in which the sheet material would be rolled onto or unrolled from a bobbin and fed into a machine; "CD" refers to cross direction, which is perpendicular to the machine direction. See FIGS. 8 and 9.

From Table 4, it can be seen that homogenised sheets comprising clove particles as described herein exhibit tensile strengths at peak in both the cross direction and the machine direction that are higher than for the comparable density 100% tobacco cast leaf sheet.

While several illustrative embodiments of the invention have been shown and described, numerous variations and alternate embodiments will occur to those skilled in the art. Such variations and alternate embodiments are contemplated, and can be made without departing from the scope of the invention.

The invention claimed is:

1. An aerosol-generating article, comprising:

a rod of an aerosol-generating substrate comprising one or more gathered sheets of homogenised plant material formed of particulate plant material, wherein each of the one or more gathered sheets of homogenised plant material is a laminar element having a width and length substantially greater than a thickness thereof, the gathered sheet of homogenized plant material is convoluted, folded, or otherwise compressed or constricted substantially transversely to the cylindrical axis of the rod, the particulate plant material comprises between 10 percent and 40 percent by weight clove particles and between 60 percent and 90 percent by weight tobacco particles, based on dry weight of the particulate plant material, the one or more gathered sheets of homogenised plant material further comprises an aerosol former and a binder, the one or more gathered sheets of homogenised plant material have a density of from 0.3 $g/cm^3$ to 1.0 $g/cm^3$, and the one or more gathered sheets of homogenised plant material each individually comprise one or more of: a tensile strength at peak in a cross direction of from 150 N/m to 350 N/m and a tensile strength at peak in a machine direction of from 280 N/m to 620 N/m.

2. The aerosol-generating article according to claim 1, wherein the particulate plant material has a D90 value of from greater than or equal to 20 microns to a D90 value of from less than or equal to 300 microns.

3. The aerosol-generating article according to claim 1, wherein the particulate plant material is agglomerated by the binder.

4. The aerosol-generating article according to claim 1, wherein the one or more gathered sheets of homogenized plant material each individually comprise one or more of:

a thickness of between 100 μm and 600 μm, or a grammage of between about 100 $g/m^2$ and about 300 $g/m^2$.

5. The aerosol-generating article according to claim 1, further comprising an aerosol-modifying element.

6. An aerosol-generating system, comprising:

an aerosol-generating device comprising a heating element; and an aerosol-generating article according to claim 1.

7. A method of making the aerosol-generating article according to claim 1, comprising:

forming a homogenised mixture comprising particulate plant material, water, binder, and an aerosol former;

forming one or more sheets from the homogenised mixture;

drying the one or more sheets, and forming the rod of the aerosol-generating substrate by convoluting, folding, or otherwise compressing or constricting the one or more sheets substantially transversely to a cylindrical axis of the rod, wherein the particulate plant material comprises between 10 percent and 40 percent by weight clove particles and between 60 percent and 90 percent by weight tobacco particles, based on dry weight of the particulate plant material, the one or more gathered sheets of homogenised plant material have a density of from 0.3 $g/cm^3$ to 1.0 $g/cm^3$, and the one or more gathered sheets of homogenised plant material each individually comprise one or more of: a tensile strength at peak in a cross direction of from 150

N/m to 350 N/m and a tensile strength at peak in a machine direction of from 280 N/m to 620 N/m.

* * * * *